US008752474B2

(12) United States Patent
Vanek

(10) Patent No.: US 8,752,474 B2
(45) Date of Patent: Jun. 17, 2014

(54) AUTOLOADING PISTOL DESIGN

(76) Inventor: Chester F. Vanek, Shoreline, WA (US)

( * ) Notice: Subject to any disclaimer, the term of this patent is extended or adjusted under 35 U.S.C. 154(b) by 69 days.

(21) Appl. No.: 13/136,179

(22) Filed: Jul. 25, 2011

(65) Prior Publication Data

US 2012/0085225 A1 Apr. 12, 2012

Related U.S. Application Data

(60) Provisional application No. 61/400,313, filed on Jul. 26, 2010.

(51) Int. Cl.
*F41A 3/86* (2006.01)

(52) U.S. Cl.
USPC ..... 89/198

(58) Field of Classification Search
USPC ..... 89/162, 163, 177, 178, 172, 196, 14.3, 89/198; 42/1.06
See application file for complete search history.

(56) References Cited

U.S. PATENT DOCUMENTS

| | | | | | |
|---|---|---|---|---|---|
| 580,924 | A | * | 4/1897 | Browning | 89/145 |
| 1,382,197 | A | * | 6/1921 | Jolidon | 89/163 |
| 1,563,675 | A | * | 12/1925 | Tansley | 89/128 |
| 1,738,751 | A | * | 12/1929 | Bluehdorn | 89/163 |
| 2,522,192 | A | * | 9/1950 | Porter | 89/198 |
| 2,627,686 | A | * | 2/1953 | Shockey | 42/1.06 |
| 2,846,926 | A | * | 8/1958 | Kimball | 89/196 |
| 3,901,125 | A | * | 8/1975 | Raville | 89/163 |
| 4,031,808 | A | * | 6/1977 | Raville | 89/163 |
| 4,103,587 | A | * | 8/1978 | Vanek | 89/175 |
| 4,173,169 | A | * | 11/1979 | Yates et al. | 89/132 |
| 4,201,113 | A | * | 5/1980 | Seecamp | 89/199 |
| 4,388,855 | A | * | 6/1983 | Sokolovsky | 89/198 |
| 4,522,107 | A | * | 6/1985 | Woodcock et al. | 89/196 |
| 4,972,760 | A | * | 11/1990 | McDonnell | 89/196 |
| 5,054,368 | A | * | 10/1991 | Wentzel et al. | 89/196 |
| 5,060,555 | A | * | 10/1991 | Sater et al. | 89/196 |
| 5,069,110 | A | * | 12/1991 | Menck | 89/198 |
| 5,309,815 | A | * | 5/1994 | Moller et al. | 89/163 |

OTHER PUBLICATIONS

Midway USA for Shooting, Reloading, Gunsmithing and Hunting, "Wilson Combat Shok—Buff Kit 1911 Government 45 ACP", http://www.midwayusa.com, 4 pages.

* cited by examiner

*Primary Examiner* — Reginald Tillman, Jr.
(74) *Attorney, Agent, or Firm* — Weide & Miller, Ltd.

(57) ABSTRACT

A firearm such as a pistol includes a barrel which rotates and travels linearly relative to a frame of the pistol and a slide which travels linearly relative to the barrel and frame. The barrel has at least one stop located at a muzzle end for engaging at least one stop on the slide when the barrel is in a first rotational position to prevent linear movement of the slide relative to the barrel, which stops permit the slide and said barrel to move linearly relative to one another when the barrel is in a second rotational position. Another aspect of the invention comprises a control surface which is located on a barrel of a firearm. Yet another aspect of the invention comprises such features associated with a rotating, rather than tipping, firearm barrel. Yet another aspect of the invention comprises a replaceable energy buffer for a firearm.

5 Claims, 5 Drawing Sheets

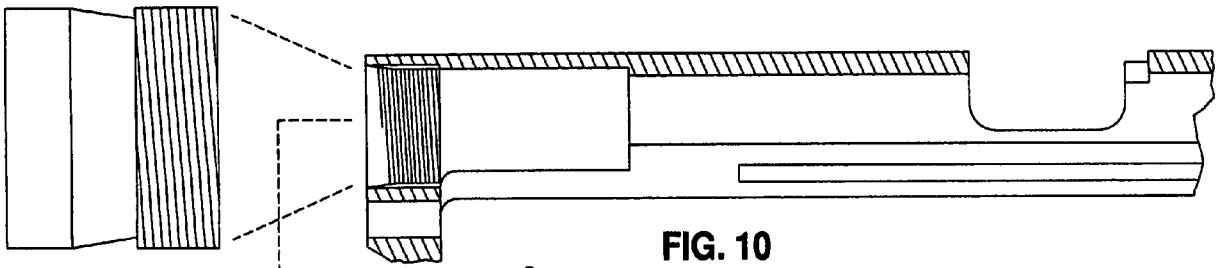
FIG. 10
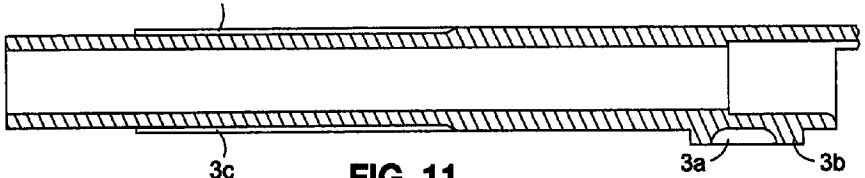
FIG. 11
FIG. 9
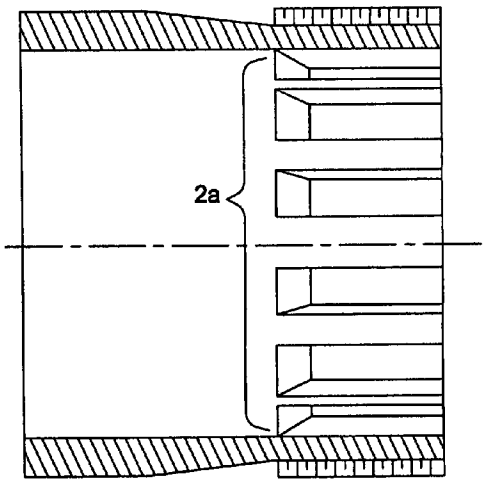
FIG. 9B
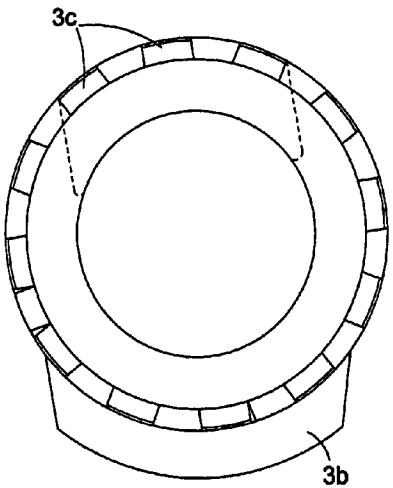
FIG. 11A
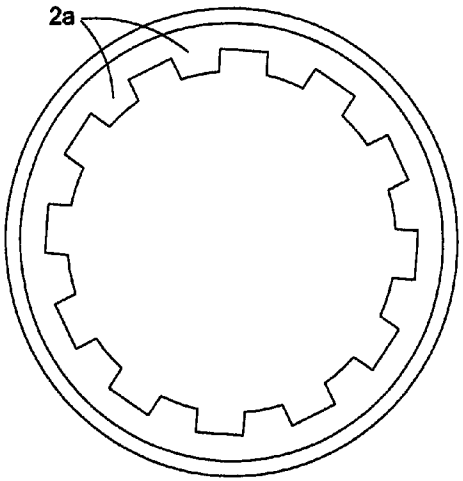
FIG. 9A

AUTOLOADING PISTOL DESIGN

RELATED APPLICATION DATA

This application claims priority to U.S. Provisional Patent Application Ser. No. 61/400,313 filed Jul. 26, 2010.

FIELD OF THE INVENTION

The present invention relates to devices, such as firearms, which are configured to launch a projectile, and particularly to a projectile auto-loading mechanism.

BACKGROUND OF THE INVENTION

The state of the art in the design of auto-loading pistols has been adequate to the task of providing reliable service using medium power cartridges and giving accuracy sufficient for self defense at moderate range. For cartridges of greater energy and for long ranges the most popular designs are not capable of delivering the needed performance. As such, magnum power cartridges have been developed for hunting and self defense situations where combatants are wearing body armor. There presently exist some gas operated pistols designed for magnum cartridges but these are generally heavy and cumbersome.

There is a growing trend toward higher energy cartridges in many popular calibers. To the 0.45 ACP has been added the 0.45 ACP+P and later the 0.45 Super. Already these cartridges may be dangerous in older 0.45 ACP pistols made with softer steels. A new cartridge, the 0.460 Rowland, is now commercially available, able to deliver 1000 foot pound magnum performance using a cartridge envelope the same as that of the 0.45 ACP, but, for safety reasons, not chamberable in a pistol designed for the 0.45 ACP. Specially adapted M-1911 pattern pistols are now built for this cartridge. They are both light and handy compared to the gas operated magnum autoloaders, because they follow the original Browning design. The adaptations added to these pistols to handle high recoil energy include lengthening the barrel and slide to six inches and adding "compensators" to moderately add to recoil weight, as well as introducing small "buffers" inside and at the rear of the recoil spring. As will be shown here, these buffer devices are ineffective.

As expected, though, these pistols still receive severe pounding at the end of recoil when the slide impacts the frame. To date, the only effective means of mitigating the destructive effects of end-of-recoil impact, aside from increasing the weight of the slide and barrel, was to increase the rate of the recoil spring. As with weight increases, this means has drawbacks—the increased difficulty of pulling the slide back to charge or clear the pistol, and also the need to strengthen the forward stop fingers at the bottom of the barrel lug (this has been done in some designs by redesigning the barrel to include a "ramp," ostensibly for aiding feed). Additionally, the assembly and disassembly of the pistol is difficult, needing a special tool or a vise, plus strength with dexterity.

Both increased slide/barrel weight and recoil spring strength appear to have reached their limits. Pistols shooting the 0.460 Rowland are not as popular as they could be because of the added weight and the difficulty of charging and assembly. Instead, magnum revolvers still dominate for hunters.

SUMMARY OF THE INVENTION

The present invention relates to projectile launchers such as firearms, and particularly the style of firearms known as pistols. One aspect of the invention comprises an innovative firearm barrel and slide having a locking mechanism, such as locking lugs, located at a muzzle portion thereof. Another aspect of the invention comprises a control surface which is located on a barrel of a firearm. Yet another aspect of the invention comprises such features associated with a rotating, rather than tipping, firearm barrel. Yet another aspect of the invention comprises a replaceable energy buffer for a firearm.

One embodiment of the invention comprises a firearm comprising a frame, a barrel and a slide. The barrel is movably mounted to the frame, the barrel having a proximal end and a distal muzzle end, the barrel extending along a first axis and configured to move linearly along that axis and to rotate about that axis, the barrel defining a passage through which a projectile may be launched, the projectile exiting a muzzle end thereof. The slide is movably mounted relative to the frame and the barrel along the axis.

At least one stop is located at the muzzle end of the barrel and at least one stop is located on the slide, the at least one stop on the barrel and the at least one stop on the slide configured to engage one another when the barrel is in a first rotational position and prevent lateral movement of the slide and the barrel relative to one another along the first axis, and configured to disengage one another and permit linear movement of the slide and barrel relative to one another along the first axis when the barrel is in a second rotational position.

In another embodiment, a firearm comprises a frame, a barrel, a slide and an energy buffer. The barrel is movably mounted to the frame, the barrel having a proximal end and a distal muzzle end, the barrel extending along a first axis and configured to move linearly along the first axis and to rotate about the first axis, the barrel defining a passage through which a projectile may be launched, the projectile exiting the muzzle .end thereof The slide defines a barrel passage, the slide being mounted over the barrel so that at least a portion of the barrel is located in the barrel passage and movably mounted relative to the frame and the barrel along the first axis, the slide having a proximal end and a distal end, the muzzle end of the barrel extending outwardly of the distal end of the slide.

In this embodiment, the replaceable energy buffer comprises body which is located between a portion of said proximal end of the slide and the frame. The replaceable energy buffer may be located over a recoil spring guide and may comprise a deformable material configured to absorb recoil energy imparted to it by the slide.

The present invention addresses the problems of the state-of-the-art recoil operated pistol, with respect to limitations of power and accuracy. A novel feature has been added to resolve the problem of high recoil and consequent slide and frame damage from use of magnum cartridges, without resort to excess weight or an overly strong recoil spring. Further, a novel form of the rotating-barrel recoil action will be introduced as a means of enhancing accuracy and strength without making the pistol too "tight" to be reliable. These means will also be seen to allow present medium power pistols to become lighter and smaller, as well as more accurate. Also, the disclosed means will be seen to add no significant cost to the fabrication of a pistol. Further objects, features, and advantages of the present invention over the prior art will become apparent from the detailed description of the drawings which follows, when considered with the attached figures.

DESCRIPTION OF THE DRAWINGS

FIGS. 9-11 illustrate an alternative configuration of a slide, lock bushing and barrel for a pistol in accordance with the present invention.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The present invention relates to projectile launchers such as firearms, and particularly the style of firearms known as pistols. In general, one aspect of the present invention comprises an innovative firearm barrel and slide having a locking mechanism, such as locking lugs, located a muzzle portion thereof. Another aspect of the invention comprises a control surface which is located on a barrel of a firearm. Yet another aspect of the invention comprises such features associated with a rotating, rather than tipping, firearm barrel. Yet another aspect of the invention comprises a replaceable energy buffer for a firearm.

While the various features of the invention are described relative to a particular pistol, it will be appreciated that various aspects of the invention might apply to other pistols, as well as other types of firearms or projectile launchers.

Firearm With Rotating Barrel and Muzzle-Located Locking Mechanism

Figure 1:
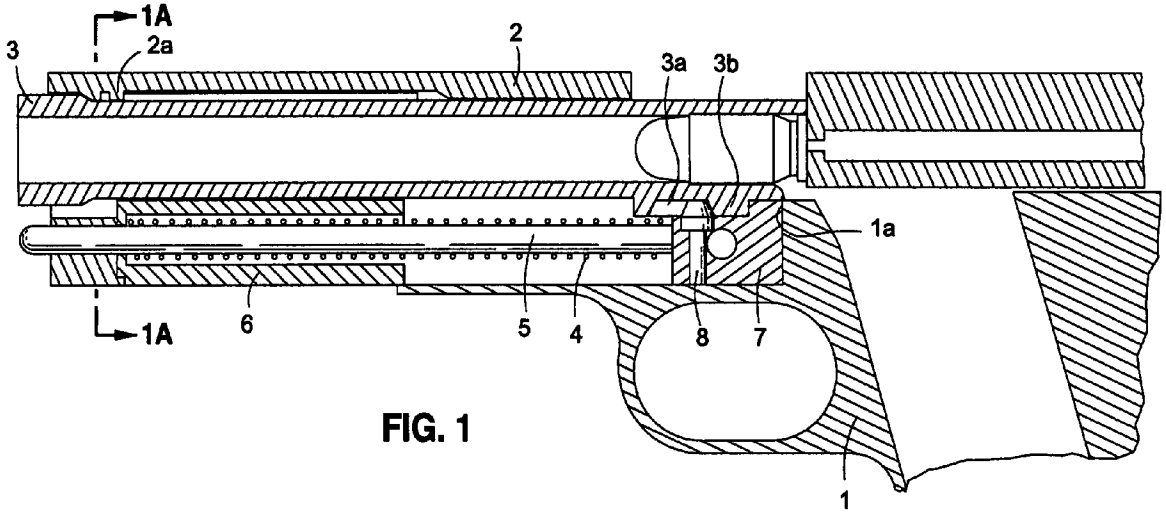
FIG. 1 is a section drawing of a pistol in accordance with the present invention in a closed, ready to fire, condition.
Figure 1A:
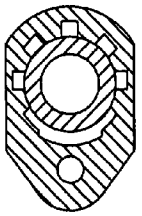
FIG. 1A is a transverse section of the pistol illustrated in FIG. 1 along line 1*a*-1*a;*

One embodiment of the invention will be described first with reference to FIG. 1, FIG. 1*a*, FIG. 2, and FIG. 2*a*. FIG. 1 illustrates a recoil operated pistol P in accordance with the invention. In the embodiment illustrated, the pistol has exactly the same envelope as the M-1911 pistol, except that the barrel length is 6 inches as is mandated minimum for hunting pistols in some states of the U.S. The barrel could be made to five inches with acceptable loss of the impact mitigation capability that will be described.

The piston P has a frame 1. In this embodiment, the frame 1 is a M-1911 pattern frame, thus only those parts of the frame relevant to the disclosed novel features are shown. These novel features reside in the slide, barrel and small parts and have minimal impact on the M-1911 frame. In fact, a design feature incorporated into this embodiment of the invention is that an M-1911 frame modified to accept this invention could be reassembled with a standard tilting barrel and slide to operate as originally intended (rather than with the slide and barrel of the present invention).

Figure 2:
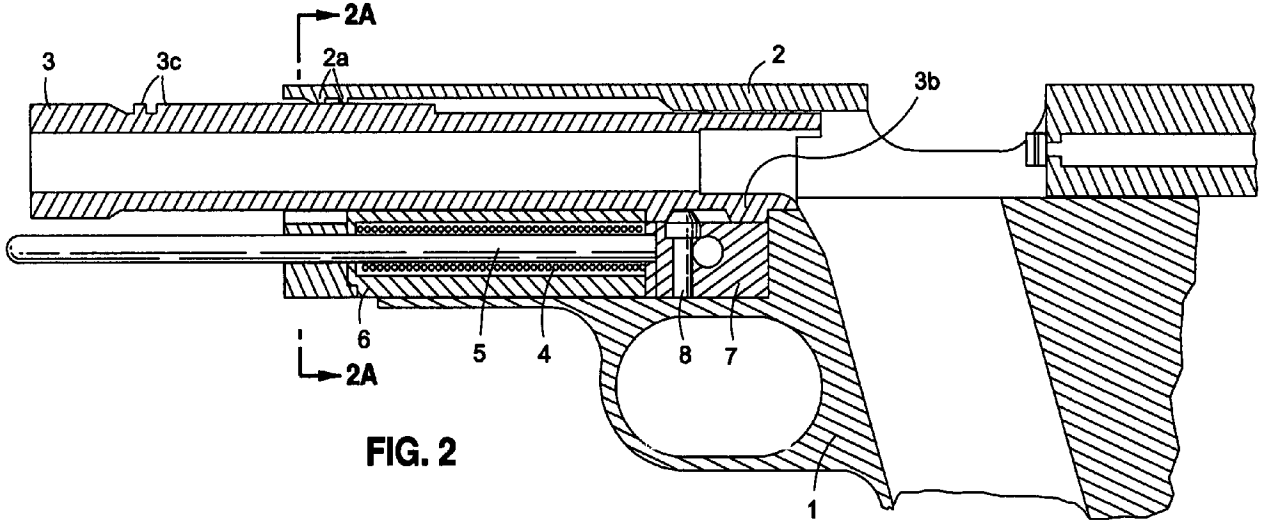
FIG. 2 is a section drawing of the pistol illustrated in FIG. 1 in a fully open condition.
Figure 2A:
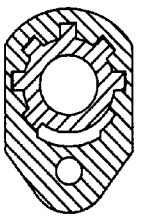
FIG. 2A is a transverse section of the pistol illustrated in FIG. 2 along lines 2*a*-2*a;*

The frame 1 illustrated in FIGS. 1 and 2 only differs from a standard M-1911 frame because it has received a "scallop" cut into the top edges of the barrel lug pocket. The scalloping is deep enough to allow a 0.875 inch diameter cylinder to sit on the pocket as the unlocked 0.687 diameter M-1911 barrel would. This scallop cut is not deep enough to compromise the frame railings opposite it.

Figure 7:
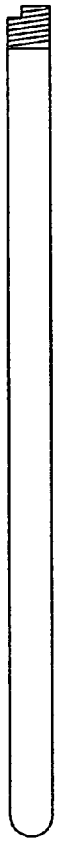
FIG. 7 illustrates a recoil spring guide rod in accordance with the invention.

Attached by the standard railings is a slide 2, and housed in the slide 2 and frame 1 is a barrel 3. Below the barrel 3 is seen a recoil spring 4, stabilized by a spring guide rod 5 (see also FIG. 7). Surrounding the recoil spring 4 is the massive replaceable buffer 6. To the rear of the recoil spring 4 and guide rod 5 is a guide base 7 (see also FIG. 6), a part which fits into the barrel lug pocket of the M-1911 frame and is retained therein by a standard takedown pin that normally passes through a lower link hole of the M-1911 barrel link.

The barrel 3 is mounted to the frame 1 and extends along a first axis. The barrel 3 defines a projectile passage through which projectiles are launched. The barrel 3 has a first or proximal and a second muzzle or distal end. Projectiles are fed into the proximal end of the barrel 3 and are launched from the muzzle end.

The slide 2 similarly has a first or proximal end and second distal or muzzle end. The slide 2 preferably extends over the barrel 3, such as by defining a barrel passage for accepting at least a portion of the barrel 3. In a preferred embodiment, the barrel 3 extends through the barrel passage of the slide 2, with the muzzle end of the barrel 3 extending outwardly of the distal end of the slide 2.

As described below, the barrel 3 is preferably mounted for linear movement along the first axis relative to the frame 1 and also for rotational movement about or around that axis. Likewise, the slide 2 is mounted for linear movement relative to the barrel 3 and frame 1, along the first axis.

By the term "along" the first axis, it is meant that the barrel 3 and slide 2 move in a linear path parallel to the first axis.

Figure 8B:
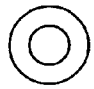
FIG. 8 illustrates a guide finger in accordance with the invention.
Figure 6A:
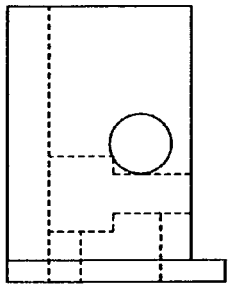
Figure 6C:
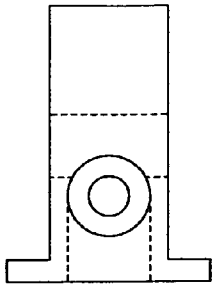
Figure 8A:
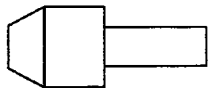
Figure 5A:
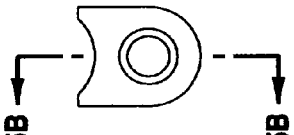
FIGS. 5-5B illustrate aspects of a replaceable buffer in accordance with the invention.

In the guide base 7 is retained a guide finger 8 (see also FIG. 8). This finger is seen to rise into a guide slot 3*a* which is cut into a center of a barrel guide/stop lug 3*b* which is formed on the underside of the barrel 3.

Figure 4:
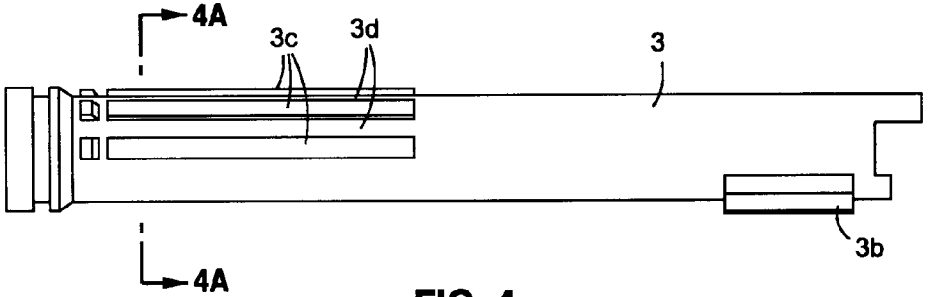
FIGS. 4-4C illustrate a barrel of the pistol illustrated in FIG. 1.
Figure 4B:
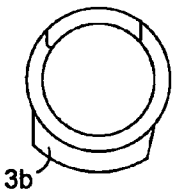
Figure 4A:
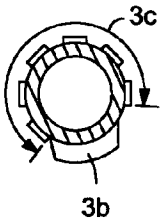
Figure 4C:
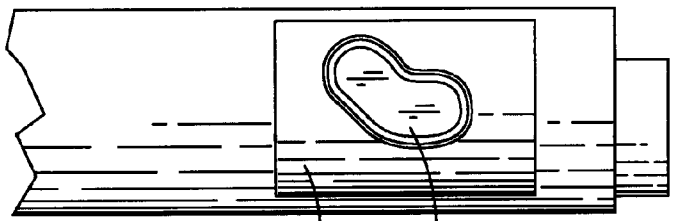
Figure 6B:
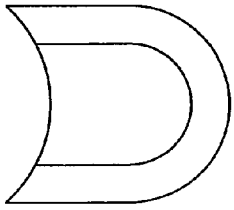
FIG. 6 illustrates a guide base in accordance with the invention.
Figure 6D:
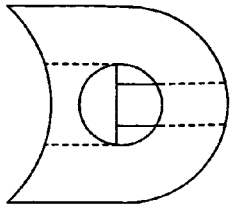

FIGS. 4, 4*a*, 4*b*, and 4*c* illustrate the barrel 3, showing the guide/stop lug 3*b* from several vantage points. FIG. 4*c* discloses the shape of the guide slot 3*a* which is cut therein.

Figure 3:
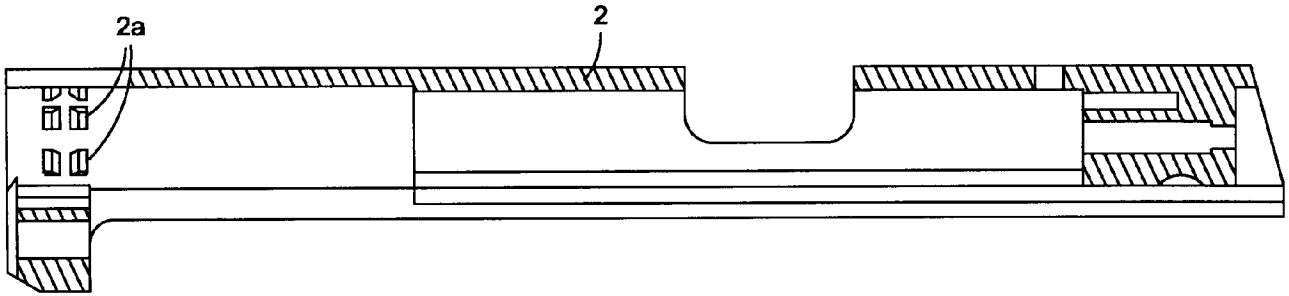
FIG. 3 is a cross-sectional figure illustrating a slide of the pistol illustrated in FIG. 1
Figure 3A:
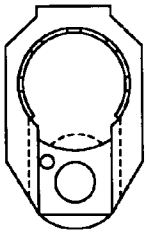
FIG. 3A is an end view of thereof.

Referring to FIG. 1, the slide 2 and barrel 3 have associated selectively mating stops. In one embodiment, these stops comprise one or more lugs. In particular, in a preferred embodiment, at a muzzle of the pistol P are located tandem locking lugs 2*a* which are integral with the slide 2. These lugs 2*a* comprise one set of an indexed ring of six such double lugs cut into the muzzle of the slide 2. FIG. 3 illustrates this arrangement in more detail.

As illustrated in FIGS. 1, 2 and 4, the barrel 3 preferably has mating lug sets 3*c,* near its muzzle. These are also six in number. In one embodiment, a single ring of lugs could be sufficient to lock the barrel 3 to the slide 2, but one or more extra rows are preferably included.

The lug sets are preferably spaced 22.5 degrees apart so a rotation of that same number of degrees will suffice to either lock or unlock the barrel 3 to the slide 2. Two sets of lugs at the bottom of the index have been machined out to allow assembly by insertion of the barrel through the slide muzzle in the standard fashion.

The invention thus defines a unique and novel configuration in which barrel and slide lock lugs are located at the muzzle. In addition, the "control surface," i.e. that surface which keeps the barrel of a recoil operated firearm in the rear, ready to feed and then lock, position while the slide is open, is located on the barrel itself. In existing firearms, the control surface is a feature of the slide, not the barrel. For example, the M-1911 pistol has as its control surface the ceiling of the bore in the slide in front of the slide's locking lugs. With the slide open, the barrel must stay in the down-and-to-the-rear, unlocked position because this ceiling formed as part of the slide bore will not allow the barrel to rise. This maintains the barrel in position to receive a cartridge and then to mate its lock lugs with those of the slide only when the slide has fully closed with the barrel.

Other rotating barrel recoil action pistols are known, such as the Roth-Steyr, The Steyr-Hahn, the 9 mm Czech, the Obregon, the Chinese qsz 92 (or NP 42, or CF 98), and the STI GP-6, another Czech design. All of these pistols have locking lugs located at the rear or middle of their barrels. These lugs mate to locking recesses cut into their slides. As unlocking is performed in these pistols, a barrel guide lug is forced to rotate in a helical recess in the frame. The resulting rotation imparted to the barrel causes its lock lugs to rotate out of the slide's locking recesses. Connected to these recesses are longitudinal channels or flats cut into the slides of these pistols, in which the lock lugs of the barrel are forced to follow as the slide retracts after unlocking. These channels cut in the slide are the control surfaces of all of the above named pistols. The barrels of these pistols are constrained to remain in the rear, unlocked position as the slide operates to eject and feed, because the channels cut in the slides keep the barrels from rotating and the barrel guide lugs cannot move longitudinally in the frame's helical slot if they cannot rotate. Thus do the above named pistols follow the same reliable operating protocol as the M-1911, keeping the barrel securely locked in its rearward, unlocked location during slide movement after unlocking.

On the other hand, in accordance with the present invention, behind the barrel's lock lugs at the muzzle are channels 3*d* (see FIGS. 4, 4*a*) which are cut or otherwise extend longitudinally in the barrel 3 to form the barrel lock lugs, 3*c*. These channels form the novel control surfaces on the barrel 3. The short muzzle mounted slide lugs 2*a*, as illustrated in FIG. 3, ride through the control channels as the slide cycles, keeping the barrel in the rear, unlocked position.

Function and Advantages of the novel Rotating Barrel Short Recoil Action

Referring to FIGS. 1 and 2, the operating cycle of the pistol P begins with the ignition of a projectile cartridge. This is facilitated in the standard manner by impact of the M-1911 hammer on a flying firing pin (not shown in the figures). The bullet associated with the cartridge acquires a given total momentum and energy from the charge as it passes the muzzle, and the slide is, in reaction, given the opposite momentum and energy related directly to that of the bullet by the factor Mass (bullet)/Mass(slide+barrel). Since the starting point configuration of the parts of the pistol P is as in FIG. 1, the barrel 3 is seen to begin the cycle locked to the slide 2. The barrel 3 can neither move forward relative to the slide 2 because of the conjunction of its muzzle mounted lock lugs with those of the slide, nor rearward since the barrel hood abuts the bolt-face of the slide. The barrel 3 also cannot rotate because the frame-mounted guide finger 8 is located at the rear of the guide slot 3*a* which is cut into the guide/stop lug 3*b* mounted at the rear underside of the barrel 3. With the stationary guide finger in this part of the guide slot 3*a*, the barrel 3 must have a given rotational position. This position is mechanically defined by design as that at which the muzzle mounted lock lugs 3*c* of the barrel 3 and the lock lugs 2*a* of the slide 2 are locked against each other.

As the slide 2 and barrel 3 recoil, the barrel's guide slot 3*a* moves rearward over the frame mounted guide finger 8. The curvature machined into the guide groove 3*a* forces it and the barrel to rotate along a left-hand screw path as further rearward movement occurs. When the slide 2 and barrel 3 have moved about 0.25 inches, the barrel 3 will have been forced to rotate 22.5 degrees. At this position the barrel 3 and slide lock lugs 3*c* are disengaged and the barrel guide/stop lug 3*b* strikes the M-1911 barrel stop lug 1*a*, (this is the face at the back end of the barrel link-lug pocket which the M-1911 barrel lug also strikes at its end of travel). The barrel 3 halts relative to the frame 1 in exactly the same location as the original M-1911 barrel. This facilitates feeding from a standard magazine mounted in the frame 1. The unlocked slide 2, however, continues rearward and in doing so its muzzle lock lugs 2*a* slide through the control channels 3*d* in-between the extended barrel lock lugs 3*c*, thus keeping the barrel 3 rotationally immobile in the unlocked state. Because this rotational location is the left-most rotated position the barrel 3, the barrel is sequestered longitudinally at its rearmost position in the frame 1, since the mechanical conjunction of the guide slot 3*a*, and the frame's guide finger 8, demands this.

The slide 2 freely cycles back and forth, performing the functions of auto-loading the next cartridge. The barrel 3 remains in the unlocked feed-ready location just as it does in the M-1911. But the barrel 3 is kept there by an inability to rotate, rather than an inability to rise upward, since anti-rotation control surfaces 3*d*, which are located on the barrel impinge on lugs 2*a* which are machined or otherwise formed in the muzzle of the slide 2, rather than because the slide ceiling keeping the barrel from rising. FIG. 2 illustrates the slide 2 at its rearmost position. FIG. 2 illustrates the location of the barrel guide/stop lug relative to the guide finger and the M-1911 barrel stop lug and the impact point of the rear of guide/stop lug 3*b* and the frame's barrel stop lug 1*a*.

When the slide 2 has returned to the point where its bolt-face contacts the rear of the barrel-hood, the slide lock lugs 2*a* are freed from the barrel control channels 3*d* and the barrel 3 is free to rotate. Now further forward movement of the slide 2 will carry the barrel 3 with it. The barrel's guide groove 3*a*, which track the frame mounted guide finger 8, will force the barrel 3 to rotate into the locked configuration of FIG. 1. Finally, as rotation into full lock is achieved, the rear end of the guide groove strikes the guide finger, halting movement of the barrel and slide relative to the frame.

If a magazine with a cartridge were in position (none shown in FIGS. 1 and 2), the next cartridge would have been loaded into the chamber in a manner consistent with operation of short recoil operation. Locking would have been accomplished via barrel rotation, but through the novel mechanism herein described.

The advantage of this form of short recoil action is that it is inherently more accurate than the tipping barrel approach of reloading. In particular, in accordance with the present invention, the barrel 3 is always in line with the slide 2, and hence the sights. Locking and unlocking do not require that the barrel be moved laterally up and down in the slide or that the locked state be "tuned" or tightened to maximum height just before the pistol won't properly close, in order to maximize accuracy (this puts accuracy and reliability at loggerheads in tipping barrel recoil actions).

Another advantage is that using the disclosed novel form of rotating barrel action, manufacturing of the parts becomes easier and less costly than for rotating barrel actions that are designed around control surfaces carved or formed into the slide. To cut or form flats or channels as control surfaces on the outside of the barrel is less difficult than to cut or form these on the inside of a slide. The lock lugs of the slide of the present invention can be formed using the same broach that is used to form the lugs of the M-16 barrel extension. This is afforded by the muzzle location of these lock lugs, which again makes less expensive manufacture with standard tooling possible.

Further, the slide lock lugs need not be formed integral to the slide, but can be made in a small part, which can be called a "barrel lock bushing", as illustrated in FIG. 9, FIG. 9*a* and FIG. 9*b*. This bushing can then be installed in a slide 2 as shown in FIG. 9 and FIG. 10. The slide 2 becomes yet easier to fabricate, and the bushing, as illustrated in FIG. 9*a*, can have a full circle index of lugs because it is installed after the barrel 3. The barrel 3 becomes a yet lighter piece, as illustrated in FIG. 11, in this embodiment of the invention, and this is advantageous in short recoil operation, since the barrel impacts the frame at the vector sum of full recoil velocity and unlocking velocity.

The barrel of the disclosed invention has one more advantage over tipping barrels. The barrel of the present invention makes maximum use of available steel to hold pressure. Note that other pistols using the tipping barrel configuration must have reduced wall thickness at the top, at a location close to the chamber, in order to provide for locking lugs and to remove metal that would interfere with the mandatory control surface of the slide ceiling discussed earlier. The M-1911 barrel is only 0.062 inch thick at its top in the proximity of the locking lugs. With the 0.460 Rowland rated at 40,000 c.u.p., which is almost twice that of the 0.45 ACP, high strength steel is needed to make a Rowland barrel that one can be confident of. The barrel of the present invention does not suffer this problem. It can retain its original chamber diameter and wall thickness throughout its length. Or as in FIG. 11, it can reduce effective wall thickness to lower values toward the muzzle end of the barrel where pressure has already dropped, while keeping strength in the high pressure region near the chamber.

Finally, it is of note that the present invention uses a replaceable bolt, as illustrated in FIG. 12. This bolt is designed to be inserted through the muzzle before the barrel and locked by rotation until a spring plunger snaps in. This is not a critical feature but is facilitative of installation of small parts and can also be used to change calibers in combination with the appropriate barrel and magazine. It is designed to be removable only with a coin as a levering tool.

Function and Advantage of the Massive Replaceable Buffer (MRB)

Referring to FIGS. 1 and 2, the pistol P may also include at least one MRB. The MRB 6 acts to fully absorb the impact energy between the slide 2 and the frame 1 after the slide has traveled to the full rearward position shown in FIG. 2.

By way of background, to reliably function, an auto-loading pistol must overcome two strongly variable factors that can change dramatically from shot to shot. The first is load variation—differing bullet weights and charges create an environment of large variation in the amount of recoil energy the slide will be given. The second is effective frame mass. This can vary depending on whether one is firing the first shot of a full magazine vs. firing the last. Also as important is the hand weight and grip of the shooter. A woman with small hands gripping the pistol more weakly with her elbow bent will reduce effective frame mass greatly compared to a 200 pound, vise-fisted, two-hand, straight-arm-holding, comp gun champ.

To reliably function, a pistol must load itself under the worst conditions, a petite lady firing her last round of mid range target load, expecting the slide to get back far enough to lock open. This dictates that the recoil spring not be too strong. A related factor is that the lady might not be able to charge the pistol in the first place if the spring were too strong. Fortunately, the energy required to reliably cycle a short recoil pistol is only about one to two foot lbs.

The problem with this is that the same pistol must also function without breakage in the hands of our comp gun champ using full factory loads. The recoil spring may have been easy to pull back on, but the slide will now be hammering at the frame very hard, and with each shot, the two are peening each other, work hardening the steel at the impact site until it cracks. With magnum loads, such as the 0.460 Rowland, this effect will quickly ruin the pistol unless it is reduced. As stated in the introduction, increasing slide and barrel mass helps reduce the initial recoil energy and increasing the recoil spring strength helps absorb more of that energy, both by turning it into spring potential energy, and by applying greater force to the frame and hand, through the spring, before impact. This accelerates the frame and hand to a greater rearward velocity before impact, reducing the impact energy, which is a function of the square of the velocity difference in any collision.

Figure 5:
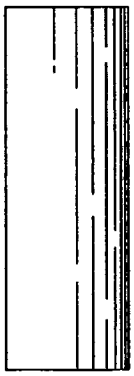
Figure 5B:
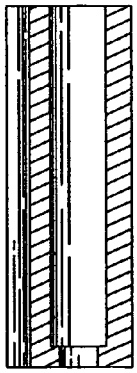
Figure 12B:
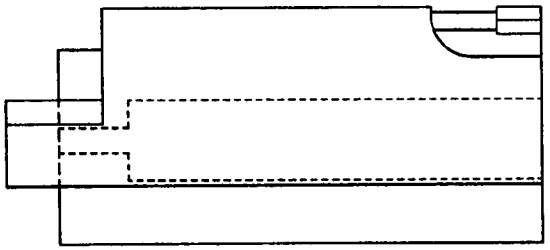
FIG. 12 illustrates a bolt for the pistol illustrated in FIG. 1.
Figure 12A:
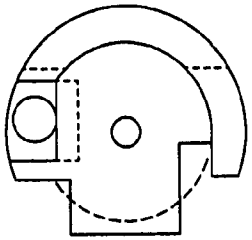
Figure 12D:
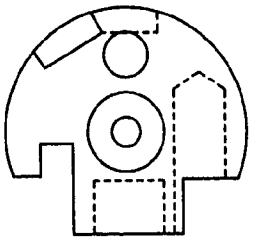
Figure 12C:
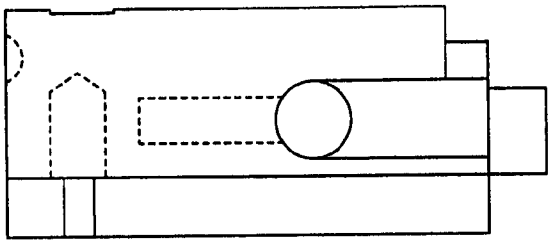

However the problems with both strategies limit their use. The comp gun champ's mother ought to be able to use his pistol if she needed it. The MRB in accordance with the invention solves this problem. As seen in FIGS. 1, 2, and 5, the MRB 6 is a simple solid "U" shaped part, hollowed to allow the recoil spring to reside inside. As illustrated in FIGS. 1 and 2, the slide 2 itself is machined to have a relatively short recoil spring housing/dust cover under the muzzle. The M-1911 was designed with a full length dust cover that serves as a solid impact support for the slide. However, by reducing the length of this housing, one can put in place a large piece of material that is softer and more resilient than either the slide or the frame steels. It will be this part that absorbs the impact energy at the end of recoil. The dust cover of the slide of this invention has been converted into a rear facing flange. In this embodiment of the invention, compensation for the shorter length is had through more massive construction under the muzzle than that of the M-1911 slide.

The MRB 6 is a part designed to deform before peening the frame and slide surfaces that impact it. For example, it can be made of soft steel that is hardened on either end. As the MRB is crushed between slide and frame at the end of recoil, as in FIG. 2, its center will permanently deform absorbing impact energy before frame and slide metal is stressed beyond its elastic limit. Proper design and metallurgical properties will allow it to deform at a uniform predictable rate.

Because the MRB 6 uses the maximum volume available under the barrel it will deform slowly, allowing it to last through hundreds of shots. This feature will also allow the possibility of using other materials such as anodized aluminum alloy or high impact elastomer or polymer. The MRB 6 can be made inexpensively and can be easily replaced during normal takedown for cleaning. These features allow the MRB 6 to be treated as an expendable part, second only to ammunition. It is anticipated that the MRB 6 can be so designed that it could be replaced without field disassembly of the pistol.

Some attempts have been made to place small parts in the recoil spring recess of the existing M-1911 hardware in an attempt to buffer recoil impact. However, the absolute size of such parts precludes them from being effective in absorbing the approximately ten ft. lbs. of energy that must be dissipated when the slide comes back following discharge of a cartridge like the 0.460 Rowland. For example, study of the maximum energy absorbable by polyurethane bumpers before damage occurs shows a clear relationship between size and the number of ft. lbs. that can be handled. Only redesign of the entire recoil spring housing of the M-1911 slide, to accommodate the largest MRB the pistol's envelope could tolerate, would allow an effective buffer part to come into being.

With an MRB 6, the pistol can be lightened and the recoil spring can be made more manageable. One could fire mid range loads mixed with magnums and reliably function the arm at each shot. The most expensive parts of the pistol, the frame and the slide, would not be the parts that suffer deformation under impact shock. This would be the job of an MRB, an inexpensive easily replaceable part.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A firearm configured to launch a projectile comprising:

a frame;

a barrel movably mounted to said frame, said barrel having a proximal end and a distal muzzle end, said barrel extending along a first axis and configured to move linearly along said first axis, said barrel defining a passage through which a projectile may be launched, said projectile exiting said muzzle end thereof;

a slide, said slide defining a barrel passage, said slide mounted over said barrel so that at least a portion of said barrel is located in said barrel passage, said slide movably mounted relative to said frame and said barrel along said first axis between a forward and a rearward position, said slide having a proximal end and a distal end, said muzzle end of said barrel extending outwardly of said distal end of said slide;

a spring guide rod extending outwardly from said frame generally parallel to said barrel;

a recoil spring mounted over said spring guide rod, said recoil spring configured to bias said slide towards said forward position; and a replaceable impact buffer comprising a generally solid body, said replaceable impact buffer configured to be connected to said slide so as to move with said slide during operation of said firearm and to be disconnected from said slide for replacement, said replaceable impact buffer defining a rod passage through which said spring guide rod and said recoil spring extend when said replaceable impact buffer is located between a portion of a proximal end of said frame and a portion of said slide, said replaceable impact buffer preventing said slide from impacting said frame upon recoil of said slide during firing of said firearm, said portion of said frame comprising a material having a first hardness and said portion of said slide comprising a material having a second hardness, at least a portion of said replaceable impact buffer comprising a material having a third hardness which is less than said first and second hardness, whereby said replaceable impact buffer absorbs recoil energy by permanently deforming between said slide and said frame upon impacting said frame when said firearm is fired.

2. The firearm in accordance with claim 1 wherein said recoil spring has a first end which abuts said frame and wherein said replaceable impact buffer defines a spring stop, wherein a second end of said recoil spring abuts said spring stop.

3. The firearm in accordance with claim 1 wherein said replaceable impact buffer comprises an elongate body having a first end and a second end and a generally "U" shaped cross-sectional shape.

4. The firearm in accordance with claim 1 wherein said slide defines a recoil spring housing and dust cover said replaceable impact buffer serves as a removable extension of said recoil spring housing and dust cover.

5. The firearm in accordance with claim 1 wherein said replaceable impact buffer has a first end, a second end and a central section between said first end and said second end, wherein said first end and said second end of said replaceable impact buffer have a higher hardness than said central section, whereby said central section of said replaceable impact buffer is configured to deform permanently to absorb impact energy.

* * * * *